US005377704A

United States Patent [19]

Huddle

[11] Patent Number: 5,377,704

[45] Date of Patent: Jan. 3, 1995

[54] AUTOMATED AGITATED IMMERSION WASHER

[76] Inventor: Richard F. Huddle, Nathaniels Hollow, Cincinnati, Ohio 45249

[21] Appl. No.: 73,100

[22] Filed: Jun. 8, 1993

[51] Int. Cl.[6] ..... B08B 3/04

[52] U.S. Cl. ..... 134/76; 34/69; 134/147; 134/160; 134/161

[58] Field of Search ..... 134/66, 76, 82, 83, 134/147, 160, 161, 165; 34/69

[56] References Cited

U.S. PATENT DOCUMENTS

| | | | |
|---|---|---|---|
| 1,249,286 | 12/1917 | Stone | 134/161 X |
| 1,624,026 | 4/1927 | Utz | 134/82 |
| 2,619,781 | 12/1952 | Buhrer | 134/161 |
| 2,824,029 | 2/1958 | Zinty | 134/161 X |
| 2,865,145 | 12/1958 | Lans | 134/161 |
| 2,921,008 | 1/1960 | Hauck et al. | 134/83 X |
| 3,006,351 | 10/1961 | Grube | 134/161 X |
| 3,102,057 | 8/1963 | Umbricht et al. | 134/82 X |
| 3,910,297 | 10/1975 | Pinkham | 134/161 X |

FOREIGN PATENT DOCUMENTS

| | | | |
|---|---|---|---|
| 34386 | 3/1922 | Norway | 134/161 |
| 1550332 | 8/1979 | United Kingdom | 134/83 |

OTHER PUBLICATIONS

Bowden Industries, Inc., "New Technology-Bowden's Three Step Answer To Safe Cleaning Of Screw Machine Parts" (3 pages).

Ransohoff Company, "ImmersoJet, Spray/Immersion Rotational Cleaning System" (4 pages).

"Powermaster Parts Washers" (2 pages).

*Primary Examiner*—Philip R. Coe

*Attorney, Agent, or Firm*—Wood, Herron & Evans

[57] ABSTRACT

An improved automated agitating immersion washer includes a wash and rinse station which operates by triple-action to agitate and rotate a basket of dirty parts with respect to fluid in a tank and further turbulates the fluid with respect to the basket to more effectively clean the parts. The washer has a two state blow-off drying station wherein one stage the basket is rotated in the presence of forced heated air while in the second stage, the basket sits stationary in the presence of forced heated air to complete the drying cycle. While the washer has an indexing mechanism which moves individual baskets through each successive stage, and each stage operates independently of the other stages so that baskets may be continually loaded and unloaded from the wash without waiting for one basket to complete all cycles of the washing sequence. The wash unit with its triple-action washing function therefore operates more efficiently with biodegradable and environmentally safe detergents than conventional washers and further has a higher throughput than conventional washers due to the independent operation of each stage and the indexing mechanism.

25 Claims, 4 Drawing Sheets

AUTOMATED AGITATED IMMERSION WASHER

FIELD OF THE INVENTION

This invention relates generally to immersion washer units for cleansing various manufactured parts, and specifically to an immersion washer which immerses the parts in a biodegradable and environmentally safe cleaning solution.

BACKGROUND OF THE INVENTION

When parts are machined and manufactured, such as parts for use in the automotive industry, they are often covered with dirt, grease, and other contaminants. Therefore, the individual parts need to be washed in order to remove the grease, dirt, and other contaminants before they are shipped to a customer. Traditionally, the parts are placed in immersion washer units and immersed in a tank containing a solvent or cleaning agent of some kind which acted to chemically break up any dirt or contaminants on the parts for more effective cleaning. However, the solvents and cleaning agents traditionally used are usually environmentally hazardous. Given the recent concern over the environment, some of the solvents used in the past have been banned from use. Further, additional solvents will probably be banned or restricted in the future. Therefore, it is necessary now to utilize a cleaning system using biodegradable and less hazardous detergents such as water-based detergents in order to clean the parts using an industrial immersion washer unit. However, such environmentally safe cleaning agents are usually less effective in chemically removing and breaking up dirt and contaminants from the individual parts, and therefore, are less effective in cleaning those parts. As a result, the available immersion washer units are inadequate for use with the safer, biodegradable detergents.

Furthermore, the traditional environmentally hazardous solvents tended to quickly evaporate so that it was relatively easy to completely dry and remove any cleaning solvent from the surface of the cleaned parts. However, the environmentally safe detergents which are replacing various traditional hazardous solvents do not evaporate as easily, and it is, therefore, more difficult to fully dry the surface of the clean parts. This is particularly a problem when the parts contain complex internal passages or cavities which tend to trap the cleaning and rinsing fluids and also when the parts are such that they cannot tolerate water spotting from a water-based detergent.

Currently available immersion washer units also suffer from the fact that each container of parts must be manually loaded and unloaded because all washing, rinsing, and drying is performed on one basket at a time. Therefore, each basket is loaded individually, completes the wash cycle and is removed by the operator, requiring constant attention by a worker.

It is therefore an objective of the present invention to present an improved automated agitating immersion washer unit which operates effectively with environmentally safe, biodegradable and water-based detergents to provide sufficient cleaning and drying of machine parts. It is a further objective to present an improved washer unit which adequately dries the parts to prevent spotting and sufficiently removes the cleaning and rinsing fluids from cavities in the parts. It is a still further objective to present an improved washer unit which more effectively washes and dries several baskets simultaneously.

SUMMARY OF THE INVENTION

The present invention is an automated agitating immersion washer with successive stations which utilizes a triple-action washing system to sufficiently clean machine parts utilizing biodegradable and water-based detergents. A basket of parts is placed in a loading position and is indexed from the loading position into a position directly above a washing tank. The basket is gripped by a dipping mechanism which lowers the basket into the tank of washing solvent. The dipping mechanism is actuated to vertically move the basket up and down in the tank and therefore agitate the parts in the solvent. A rotating mechanism coupled to the dip mechanism is utilized to simultaneously rotate the basket of parts while it is being agitated in the tank. Further, a pump system turbulates the cleaning fluid in the tank while the part basket is rotated and agitated. The triple-action washer system moves the parts vigorously in different directions with respect to the parts to clean the parts more thoroughly in the cleaning solution.

When the cleaning cycle is completed in the first tank, the dipping mechanism lifts the basket to a position where it may be engaged by an indexing system. The indexing system, through indexing fingers, moves the part basket along a path to the next cleaning station. At the second cleaning station, the basket is again engaged by a dip mechanism and lowered, rotated and agitated in a turbulating solution to further clean or to rinse the pans in the basket to remove the previous detergent.

The mechanism is then raised out of the second tank and engaged again by the indexing system which moves it to the first station of a blow off heating stage where heated forced air is blown against the basket while it is simultaneously rocked in the first station blow off chamber. Upon completing the cycle in the rocking blow off station, the basket is indexed to a second station of the blow off stage where it remains stationary to further complete the second dry cycle. Once dried, the basket is indexed to an unload station where it moves out of the washer. The parts are then removed from the basket and packaged to be shipped to the customer.

The automated agitating immersion washer of the present invention simultaneously washes, rinses, and dries several baskets of parts. For example, one basket is washed while a different basket is rinsed, and another is dried. Therefore, the processing time per basket is dramatically decreased over conventional washer units which require a complete wash, rinse, and dry cycle for a basket before another basket of parts may be loaded into the wash unit. The increased through-put of the present invention allows a larger number of parts to be washed in a given time, and therefore, increases the overall efficiency and cost effectiveness of the washer. The triple-action washing sequence and dual station rocking/stationary blow-off drying stage provides an improved cleansing of the parts and also provides adequate drying, even in parts containing openings and recesses. Therefore, the automated agitating immersion washer of the present invention provides an improved washer unit to handle the reduced cleaning ability and reduced evaporation properties of environmentally safe and biodegradable detergents.

DETAILED DESCRIPTION OF THE DRAWINGS

Figure 1:
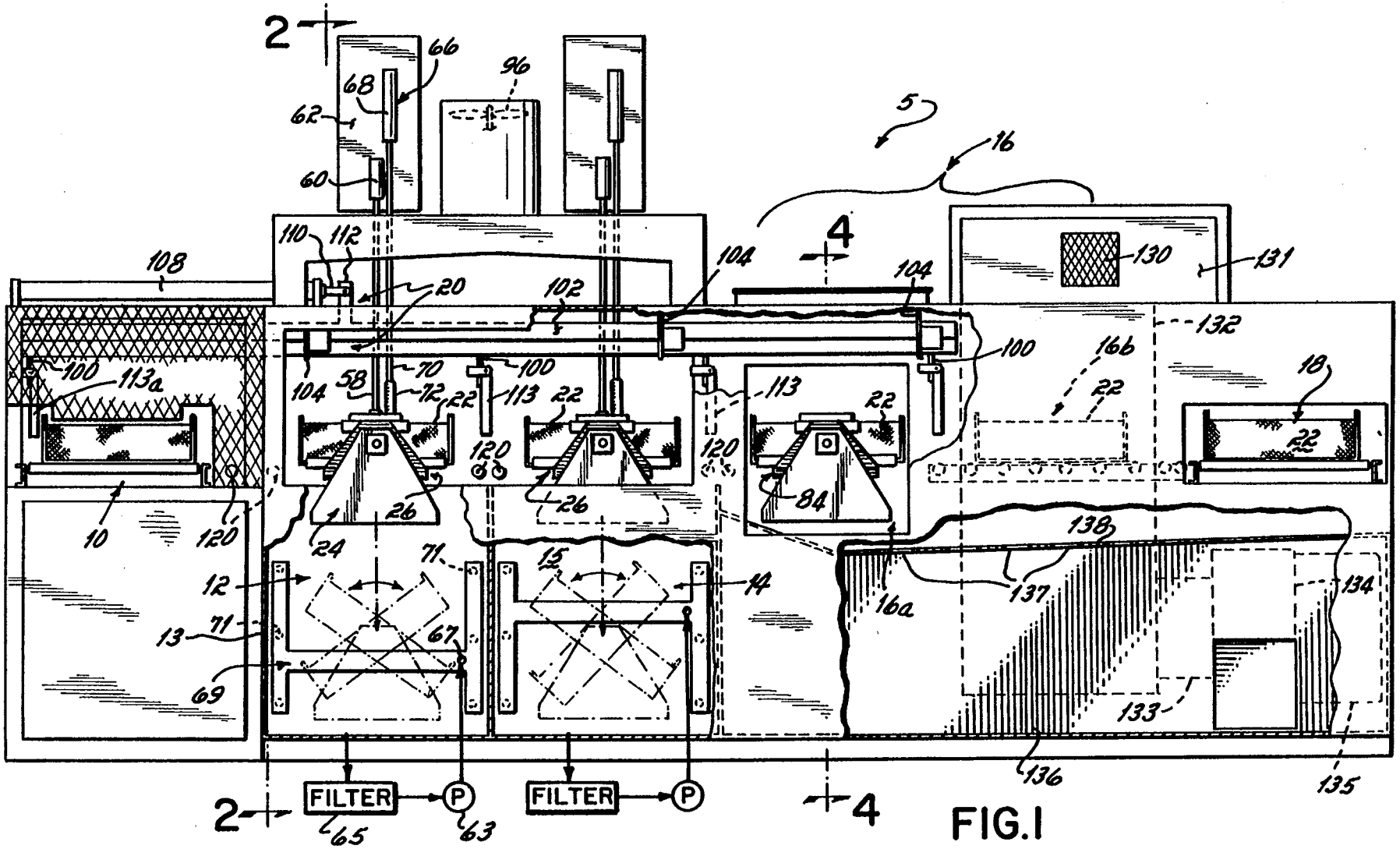
FIG. 1 is a partially broken away, diagrammatic front side view of an automated agitated immersion washer according to the principals of this invention.
Figure 2:
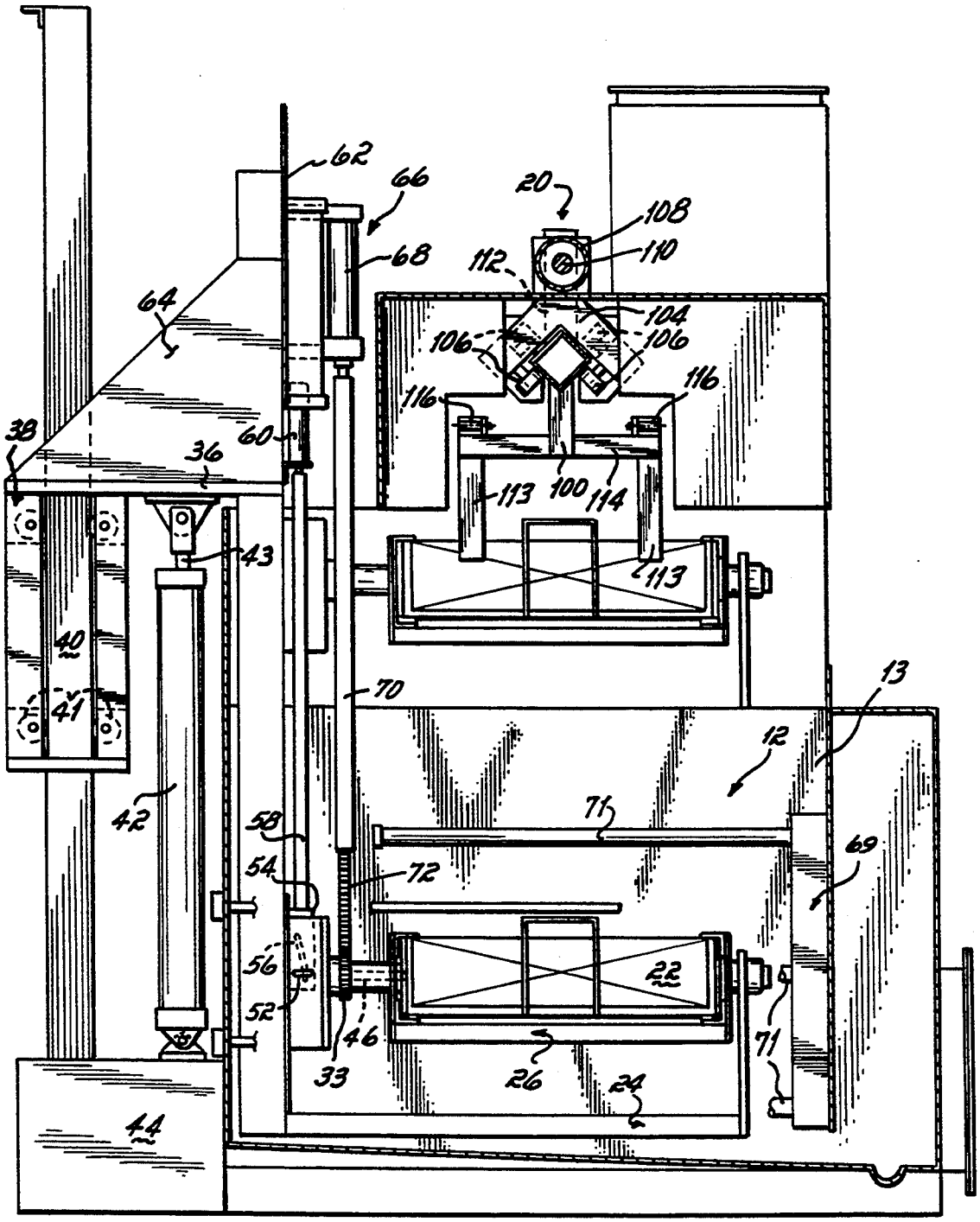
FIG. 2 is a cross-sectional view taken generally along lines 2—2 of FIG. 1.
Figure 3:
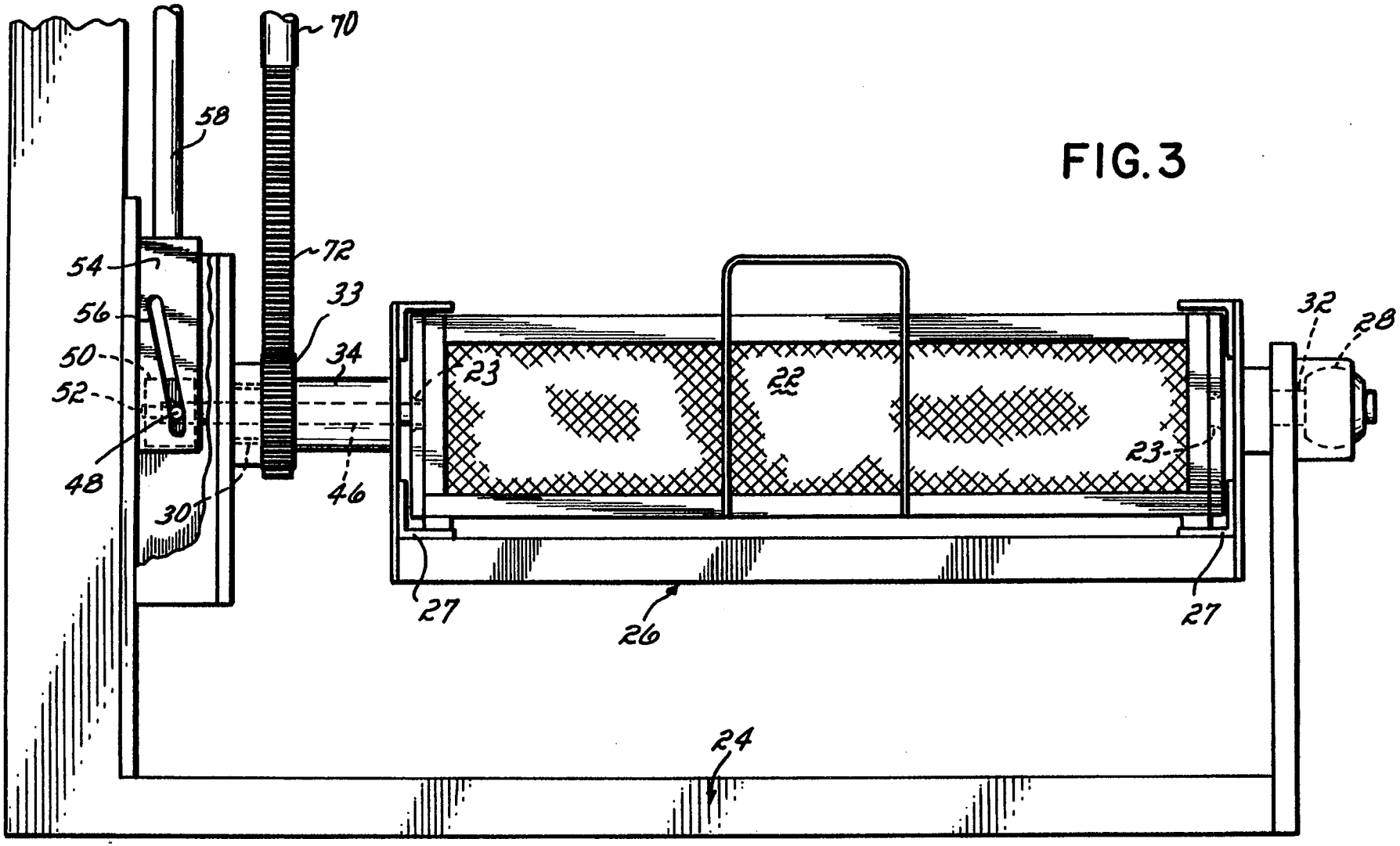
FIG. 3 is an enlarged view of a dipping frame and basket utilized in the operations of FIG. 1.

Referring to FIG. 1, a side view of the automated agitated immersion washer 5 of the present invention is shown, having a loading station 10, a first washing station 12, a second washing or rinsing station 14, a blow off state, on 16 having a rotating stage 16*a*, and a stationary blow off stage 16*b*, and an unloading station 18. The basket is placed by a handler into the loading station 10 where it is engaged by an indexing mechanism 20, whereby it may be moved through the successive washing and drying station of the washer 5. As seen in FIGS. 2 and 3, the front end view shows the basket of parts 22 placed above the first washing tank 13. The basket 22 is contained by a U-shaped dipping frame 24 wherein it is secured at two opposing ends. The U-shaped dipping frame 24 includes a rotating guide section 26 which is connected to the frame 24 at one side by a spherical bearing 28 and at the other side by a sleeve bearing 30. The guide section 26 rotates about shaft 32 and 34, respectively at its ends. The dipping frame 24 is coupled to a plate 36 which is in turn coupled to a guide sleeve 38 movably secured to a guide post 40. The guide sleeve 38 contains rollers 41 which allows sleeve 38 to move vertically along post 40. A lifting cylinder 42 extends between a base section 40 and plate 36 to act against the plate 36 and move the dipping frame vertically up and down in tank 13. When the rod 43 of cylinder 42 is extended, the dipping frame 24 and basket 22 are extended above tank 13. When the rod 43 is retracted, the frame 24 lowers basket 22 into the tank to be washed. During the wash cycle, the dipping frame 24 is continually moved up and down to agitate the basket 22 within tank 13.

The dipping frame 24 includes a pinion gear 33 that encircles one end of the shaft 34 adjacent the sleeve bearing 30 (See FIG. 3). A rack 72 engages the pinion 33 to produce rotation of the guide section 26, a shot pin 46 extends concentrically inside shaft 34 and is movable within shaft 34 to extend through section 26 and into an opening 34 in basket 22 to secure the basket to section 26 and dipping frame 24. Referring to FIG. 3, the shot pin 46 carries cross pin 48 which extends across a stationary block 50 mounted to the dipping frame 24. A horizontal slot 52 in block 50 allows the pin 48 and shot pin 46 to move toward and away from basket 22. Located outside of block 34 is an outside saddle member 54 containing identical opposing angled slots 56 at either side which engage pin 48 at its ends. Saddle member 54 is vertically movable with respect to pin 48 and block 50. As may be seen in FIG. 3, when saddle member 54 is moved vertically downward by rod 58, pin 48 follows the slot 56 to a left position away from basket 22. In this way, the pin 48 moves away from basket 22 and pulls shot pin 46 away from engagement with the basket so that basket 22 may be removed from dip frame 24. Alternatively, when the saddle 54 is slid vertically upward with respect to block 50 the cross pin 48 and shot pin 46 are moved forward against basket 22 to engage the opening 23 in basket 22 and secure the basket within section 26. Referring now to FIG. 2, the saddle member 54 is mounted to one end of a cylinder rod 58 which moves up and down in a cylinder 60 to engage and disengage the shot pin 46 and basket 22. Cylinder 60 is mounted to plate 62 which is fixed to plate 36, and cylinder sleeve 38 by a gusset 64 so that the entire shot pin assembly moves up and down with the dipping frame 24. In this way, during wash cycle of washer 5, the basket is located in dip frame 24 so that it will not move out of the frame 24 when agitated and rotated in the tank full of detergent solution. Therefore, to secure the basket to the dipping frame 24 for a wash cycle, the basket 22 is indexed into place between the opposing angle sections 27 of section 26 and shot pin 46 is inserted into opening 23 of basket 22 to hold the basket. During the wash cycle, cylinder 42 is continuously actuated to move the dipping frame 24 upwardly and downwardly to agitate the basket of parts 22 within the tank 13 of cleaning detergent.

During a wash cycle, a pump 63 is coupled to tank 13 to turbulate the washing solution and provide a more effective cleaning of the parts in the basket 22 (See FIG. 1). Cleaning detergent is drained from tank 13, passes through a filter 65, and is then pumped through pump 63 into an opening 67 in a fluid header 69, which has a plurality of distribution networks 71 to blow the pumped solution into the tank and turbulate the solution in the tank. The networks 71 distributes the solution for a generally uniform turbulation throughout tank 13. The combination of the agitation of the basket and turbulation of the solution further enhances the cleaning performance of the washer unit 5.

To still further provide effective cleaning of the machine parts in basket 22 in accordance with the present invention, a rotating mechanism 66 is provided to cooperate with dipping frame 24 in order to rotate the basket 22 with respect to its stationary horizontal position. Referring to FIG. 2, the rotating mechanism 66 includes a cylinder 68, extensible rod 70 and rack 72 attached at the end of rod 70 opposite the cylinder 68. Rack 72 engages the pinion gear 33 located on shaft 34 of the dipping frame 24. During a wash cycle, rod 70 is continually moved up and down so that rack 72 engages and rotates pinion gear 33 to rotate guide section 26 and basket 22 on shafts 32, 24. The dipping frame 24 is therefore agitated while simultaneously the basket guide section 26 is rotated and the solution turbulated. This creates a triple-action action cleaning sequence to remove even stubborn dins and surface contaminants on the parts. The triple-action washing sequence of the present invention, provides better cleaning of the machine parts in water-based and biodegradable detergents than has heretofore been possible. Since the biodegradable cleaning solution in tank 13 is not as effective at removing dirt and oils as traditional environmentally hazardous cleaning agents, the triple-action washing system of the present invention provides additional motion and exposure of the part surfaces to the cleaning solution to achieve adequate cleaning of the parts in the presence of the less effective, environmentally safe cleaning solutions.

The preferred embodiment of the washer of the present invention includes a rinsing station 14 with second tank 14 filled with rinsing solution such as water, which is used to rinse away any detergent left in the machine parts from tank 13 of the cleaning solution. The rinsing state 14 of washer 5 includes the same triple-action washing mechanism of the washing stage 12 as just described hereinabove. That is, it includes a dipping frame for agitation, a rack and pinion rotating mechanism to provide rotation of the basket during agitation, a pump system to turbulate the rinsing solution during agitation and rotation of the basket. Again, the triple-action of agitation, rotation, and turbulation of the rinse solution provides better rinsing than is possible with prior art washing units and it therefore more effectively rinses the parts and prepares them for the drying stage. The dipping/agitating mechanism, rotating mechanism, and turbulation pumps of the rinse station 14 may all be independently operated form the counterpart mechanism of the wash stage. Therefore, the wash station 12 and rinse station 14 are independent of each other and a basket 22 of the wash station 12 may be lowered to be readied for washing in the detergent solution while a basket in the rinse station 14 may be raised to be moved on to the drying station. Further, when each basket is raised from a tank, it is rotated while the shot pin is still engaged to drain the solution form the parts and to prevent contamination of the rinse solution by the wash solution.

Figure 4:
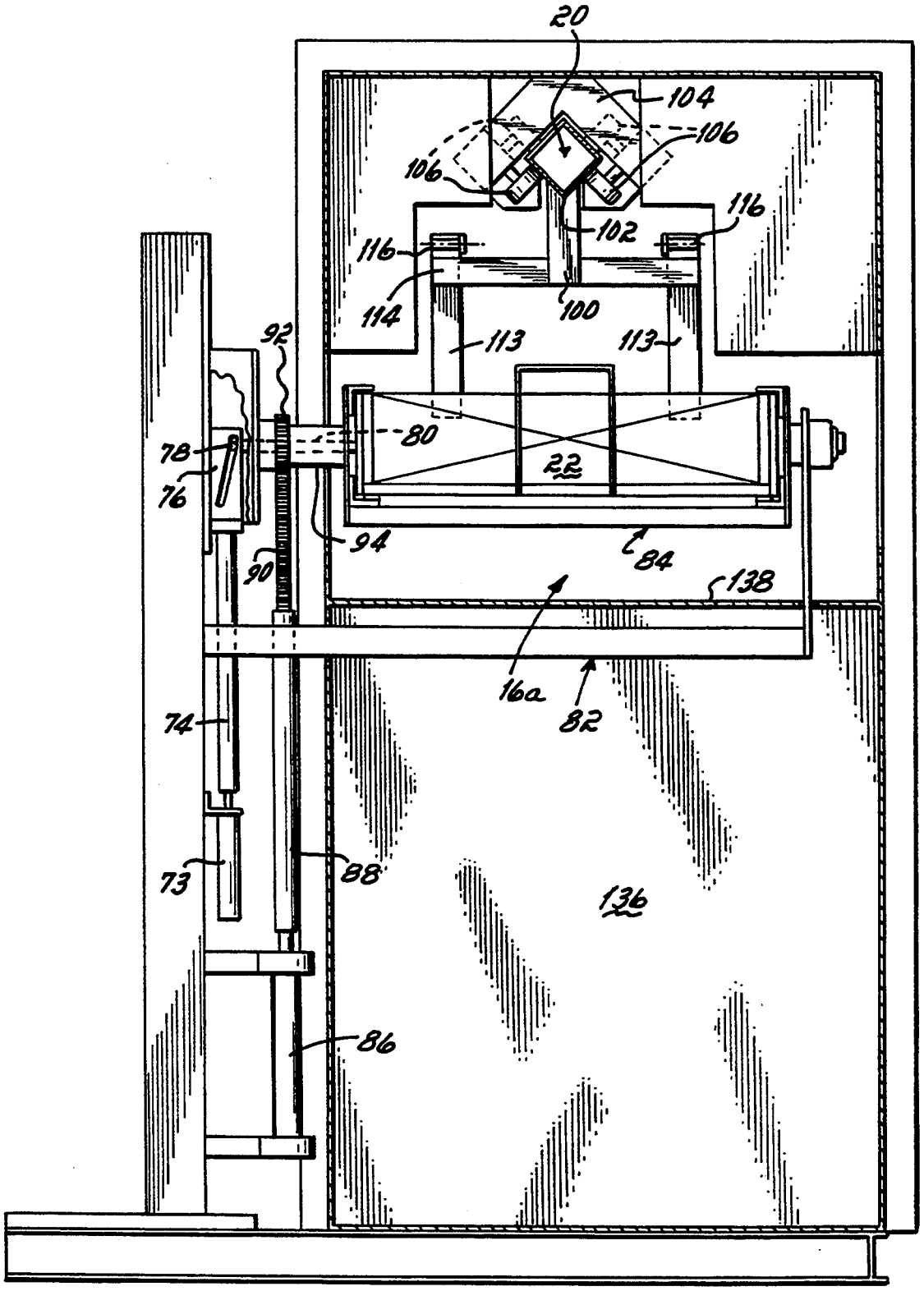
FIG. 4 is a cross-sectional view taken along lines 4—4 of FIG. 1.

After the basket has been washed and rinsed, it is moved to blow-off station 16 wherein the parts are dried. The blow-off station 16 includes a rotating blow-off stage **16*a* and a stationary blow-off stage 16*b*. In the first stage 16*a*, the rotating blow-off stage, air is blown around the washer housing to dry the parts in the basket. A conventional air circulation system includes an intake opening 130 connected to a passageway 131. The passageway 131 feeds the air into a combustion chamber 132 which heats the air by means (not shown). Heated air is then drawn through duct 133 by blower 134, powered by a motor 135, and exhausted into plenum 136 which feeds the heated air into stages 16*a*, 16b of station 16 via holes 137 in plenum ceiling 138. During the rotating blow-off stage, the basket 22 is rotated within the station to expose different areas of the parts to the heated air streams. This produces a more effective use of the heated air to result in a more efficient drying sequence. The basket in the rotating blow-off stage 16*a* is secured and rotated similar to the way in which the basket is secured and rotated in both the wash station 12 and rinse station 14. That is, referring to FIG. 4, it may be seen that cylinder 73, rod 74, saddle 76, cross pin 78, and shot pin 80 are used to extend into the opening 23 in the basket to secure basket 22 onto a stationary frame 82 much the same way that the basket 22 was secured to the dipping frame 24 as described hereinabove. However, the cylinder 72 is mounted below the basket, so that the extension rod extends upwardly to move the saddle 76 to engage and disengage shot pin 80. The drying frame 82 is stationary and does not move up and down as there is no vertical agitation in the blow-off station. The guide section 84 of the frame 82, however, does rotate to promote more efficient drying. Like the rotating mechanism of the washing and rinsing stations 13, 14, a cylinder 86 and rod 88 is used to move a rack 90 against a pinion gear 92 located on a rotating shaft 94 connected to guide section 84. During rotating blow-off dry cycle, the rod 88 is moved vertically upwardly and downwardly so that the rack 90 engages and rotates pinion gear 92 thereby rotating guide section 84 and basket 22. Rocking the basket in addition to the heated air further increases the effectiveness of the rotating blow-off stage 16*a*** because it exposes more of the surface area and any internal cavities to the streams of forced hot air for more efficient drying. While simultaneously shaking any trapped liquid form the parts.

After the rotating blow-off dry cycle, the basket 22 is moved to the stationary blow-off stage **16*b* where the drying cycle continues. The basket sits in the stationary blow-off stage where it is again exposed to heated forced air to further dry the parts and complete the drying stage. After sufficient time has elapsed in the stationary drying stage, the basket is moved out of the blow-off drying station and into the unloading station where it exits the washer unit. The clean parts can then be removed from the basket and prepared for shipment. An exhaust fan 96 is mounted on top the washer housing 6 to draw air out of the wash, rinse and drying chambers 12, 14, and 16. Make up air flows into the body of the washer 5 through the load station 10 and unload station 18 of washer 5. The fan 96 thereby draws steam away from the wash and rinse stations, reduces the humidity in the drying station and keeps the heat from the blow-off stages from escaping into the plant where washer 5** is located.

The baskets are moved through the successive washer housings by an indexing mechanism 20 comprising a series of depending index arms 100 which push the baskets to successive stations. Referring to FIG. 1, the indexing mechanism includes a rectangular beam 102 which is movable along a substantial length of the washer through the load station 10, wash station 12, rinse station 14, rotating blow-off stage **16*a*, and stationary blow-off station 16*b* and unload station 18. The beam is suspended from the top of the washer housing 6 by a plurality of yokes 104 and a plurality of rollers 106 which engage each side of the rectangular beam 102. In that way, the beam 102 is horizontally movable through yoke 104 above the successive stations generally parallel to the path the basket maintains through the washer 5. Referring to FIG. 1, a translating cylinder 108 with extensible rod 110 engages an arm 112 that is attached to the upper portion of beam 102. When cylinder 108 is actuated, rod 110 extends and moves the beam generally horizontally within yokes 104. Depending downwardly from the arms 100 are index fingers 113 which are connected by a cross bar 114 to arm 100. The indexing fingers 113 depend downward from beam 102 and are dimensioned to abut against one end of the basket 22. When the rod 110 of cylinder 108 is extended, it moves beam 102 and the index fingers 106 push the baskets into each successive washer station. As seen in FIG. 2, the index fingers are hinged at hinges 116 which allow them to pivot in one direction with respect to bar 114. Fingers 106 are configured to pivot forwardly toward the unload station 18 of washer 5 and away from the load station 10 of washer 5. However, they do not pivot in the opposite direction from the unload station 18 to the load station 10. In this way, when beam 102 is moved towards the unload side of washer 5, the index fingers engage the baskets 22 and push the baskets to the next successive station. When the rod 110 is retracted to move the beam 102 backward toward the loading station 10 so that the end most index fingers 113a can engage a new basket in the load station, the index fingers 113 pivot and slide over the baskets 22 so that they may be effectively moved to engage the next basket. In this way, beam 102 is moved by cylinder 108 back and forth to successively index and move each basket to the next washer stage. A path extends completely through the washer 5 so that a basket 22 may be moved into each successive station. This path consists of idler rollers 120 located between successive stations which cooperate with the rails 27 of the guide sections 26 of stations 12 and 14 and the rails of guide sections 84 of station 16***a*. Additional idler rollers 122 extend from station 16a to unload station 18. The combination of the index mechanism 20 of the present invention and the independently operated wash, rinse, and dry stations, allows several baskets of parts to be washed, rinsed, and dried simultaneously without waiting for each of the cycles to finish. For example, while one basket is being washed, another might be rinsed and still another might be in one of the successive blow-off dryer stages. The indexing system 20 in the successive independent stations increases the throughput of washer 5 and allows a larger number of parts to be washed in a predetermined amount of time. Currently available wash units handling one basket at a time and having, for example, a three minute wash cycle, three minute rinse cycle, and a six minute dry cycle would require a total of twelve minutes to elapse before another load of parts could be washed. However, with the washer 5 of the present invention, once the washing sequence is started, and there is a basket in each stage, a new basket of washed parts will be output at the end of the time period for completing the longest station, for example every three minutes if a three minute wash cycle is the longest time period of a station in the washer. Therefore, with washer 5 of the present invention, it is possible to automate operation of the washer so that baskets are continually moved through the successive station once they reach the load station. The present invention eliminates the necessity of having a person stand by the washer and manually load and unload the baskets because as soon as a basket enters the load station, it will be indexed to the wash station the next time it is available. The loaded basket does not sit until a complete wash, rinse and dry cycle is completed on the prior basket before it begins its progress through the washer. Washer 5 may thus be automated to include a conveyor that simply feeds a basket into the load station. The indexing mechanism 20 automatically engages the basket to move it through the successive stages of the washer. When it is completed, another conveyor belt or possibly the same conveyer belt used to load the basket may be used to carry the basket out of the washer. Therefore utilizing the washer 5 of the present invention, various different wash cycle times, rinse cycle times, and drying cycles may be established by simply actuating the various lifting, rotating and indexing cylinders to operate in a particular time in sequence. Since each station of the washer is independent of the other station and may operate upon a basket of parts while a different basket of parts is in an adjacent station, the basket of parts may be continually fed into washer 5 without waiting for one basket to pass through every station of the complete wash sequence. This amounts to a sufficient savings of time in washing the parts and therefore, increases the cost effectiveness of the washer 5. For example, if the wash cycle is approximately two minutes in duration, and the rinse cycle is approximately two minutes in duration, but boil of the drying cycles in the successive blow-off dry stages are each three minutes long, the washer 5 would still produce a basket of washed parts every three minutes once each station contains a basket, because three minutes is the longest duration of any station in the wash sequence.

While the present invention has been illustrated by description of preferred embodiment and while the preferred embodiment has been described in detail, it is not the intention of the applicant to restrict or in any way limit the scope of the appended claims to such detail. Additional advantages and modifications will readily appear to those skilled in the art. For example, the baskets in both the wash and rinse cycle might be agitated and rotated utilizing different mechanical structures than the dipping frame and rack and pinion structures utilized by the preferred embodiment of the present invention. Furthermore, additional washing rinsing and/or heating stations might be added to more thoroughly clean and dry very dirty parts. Further while the preferred embodiment of the present invention shows the baskets being loaded and unloaded into the loading and unloading stations, respectively, from the sides of the washer, the baskets might also be loaded at the ends. Accordingly, departures may be made from the preferred embodiment of the invention without departing from the spirit or scope of applicant's general inventive concept.

I claim:

1. An improved immersion washer with successive stations for washing dirty parts with a water-based environmentally-safe cleaning solution and rinsing and drying the parts comprising:

a wash station for washing a porous container of dirty parts including a wash tank to hold the cleaning solution and a wash dipping mechanism to receive said container and dip it into said tank to wash the parts in the solution, the wash dipping mechanism operable to move the container generally up and down in said tank to agitate the container of parts in the solution during a wash cycle;

a wash rotating mechanism to rotate said container on the wash dipping mechanism while it is being agitated during the wash cycle;

a pump system to turbulate the cleaning solution in said tank around the agitating and rotating container of parts;

a rinsing station spaced to one side of said wash station to rinse any residual cleaning solution from the parts rinsing station comprising a rinse tank to hold a rinsing solution and a rinse dipping mechanism to receive said container and dip it into said rinse tank to rinse the parts in the rinsing solution, the rinse dipping mechanism operable to move the container generally up and down in said tank to agitate the container of parts in the rinsing solution during a rinse cycle;

a rinse rotating mechanism to rotate said container while it is being agitated during the rinse cycle;

a rinsing pump system to turbulate the rinsing solution in said rinse tank around the agitating and rotating container of parts, whereby the washed parts are more vigorously and effectively rinsed to remove the washing solution from the parts after they pass through the wash station, a drying station spaced to one side of said rinsing station to receive said container after it has left the rinsing station and dry the washed and rinsed parts in said container; and a container transport disposed between said wash station, rinsing station and drying station, said transport drivingly engaging said container to facilitate movement of said container along a path from said wash station to said rinsing station, to said drying station.

2. The immersion washer of claim 1 further comprising an air circulation system coupled to the drying station to circulate air around and through the drying station to dry the parts in the drying station.

3. The immersion washer of claim 1 wherein the wash dipping mechanism comprises a vertically moveable dipping frame and a container guide rotatably mounted to said dipping frame, the container guide supporting and rotating a container of parts on said frame during the wash cycle as the dipping frame is moved vertically up and down.

4. The immersion washer of claim 3 wherein the wash dipping mechanism includes a shot pin assembly to project a shot pin against the container on said guide to secure the container to said guide during the wash cycle.

5.The immersion washer of claim 4 wherein the wash rotating mechanism and shot pin assembly are mounted to said dipping frame to move vertically up and down with said frame during the wash cycle.

6. The immersion washer of claim 4 wherein the shot pin assembly includes a horizontal shot pin, a cross pin fixed to one end of said shot pin generally perpendicular with said shot pin and a saddle with opposing vertical walls each having a slot to receive opposite ends of said cross pin and guide the cross pin when the saddle is moved, the slots angled in the saddle further away from said container guide at one end than at the other end, the saddle being vertically moveable between an up and down position and the cross pin following the angled slots to project the shot pin against the container and secure said container when the saddle is moved to one of the up and down positions and to withdraw the shot pin from said container and release said container when the saddle is moved to the other of the vertically up and down positions.

7. The immersion washer of claim 6 wherein the saddle is connected to a rod moveable within an actuatable cylinder wherein the cylinder may be actuated before the wash cycle to move the saddle and project the shot pin to secure the container.

8. The immersion washer of claim 3 wherein the wash rotating mechanism includes a pinion gear connected with said container guide to rotate said guide when the gear is rotated and a rack coupled to said pinion gear and moveable to rotate the pinion gear and container guide during the wash cycle.

9. The immersion washer of claim 8 wherein the rack is connected to a rod moveable within an actuatable cylinder wherein the cylinder may be actuated during the wash cycle to move the rack against the pinion gear and rotate the container guide.

10. The immersion washer of claim 1 wherein said container transport includes an overhead member spaced above the successive stations and a plurality of indexing arms extending downwardly from said overhead member to engage the containers of parts for movement through the successive stations of the washer, each arm operable to engage a first container and move the container along the path through one station and on to the next successive station when the member is moved in one direction and to disengage from said first container and move to engage a second container positioned behind the first container in the path when the member is moved in the opposite direction; whereby a forward and backward motion of the overhead member moves the container through the successive stations.

11. The immersion washer of claim 10 wherein an indexing arm is associated with each of the successive stations, each arm including a vertical hinged portion which pivots in one direction but not the other, the hinged portion engaging said first container and driving the container along the path when the member moves in the one direction and hinging upwardly and passing over the first container to engage said second container when the member is moved in the other direction wherein the indexing arms continually push and hinge as the member is moved back and forth to move the containers through the washer.

12. The immersion washer of claim 1 wherein the drying station comprises a plurality of separate blow-off stages to dry the parts and an air circulation system in communication with at least one of the blow-off stages to circulate air through said one stage and facilitate drying of the parts.

13. The immersion washer of claim 12 wherein the blow-off stages include a rotational blow-off stage with a rotating mechanism to rotate the container of parts and shake excess cleaning solution from the parts to facilitate drying of the parts and a stationary blow-off stage to receive said container after the rotational blow-off stage for further drying of the parts.

14. The immersion washer of claim 13 wherein the rotational blow-off stage includes a container guide connected with the rotating mechanism to receive the container and rotate said container and a shot pin assembly to project a shot pin against the container on said guide and secure the container to said guide while the container is being rotated for drying by the rotating mechanism during a rotational blow-off drying cycle.

15. The immersion washer of claim 14 wherein the shot pin assembly includes a horizontal shot pin, a cross pin fixed to one end of said shot pin generally perpendicular with said shot pin and a saddle with opposing vertical walls each having a slot to receive opposite ends of said cross pin and guide the cross pin when the saddle is moved, the slots angled in the saddle further away from said container guide at one end than at the other end, the saddle being vertically moveable between an up and down position and the cross pin following the angled slots to project the shot pin against the container and secure said container when the saddle is moved to one of the up and down positions and to withdraw the shot pin from said container and release said container when the saddle is moved to the other of the vertically up and down positions.

16. The immersion washer of claim 15 wherein the saddle is connected to a rod moveable within an actuatable cylinder wherein the cylinder may be actuated before a rotational blow-off drying cycle to move the saddle and project the shot pin to secure the carrier.

17. The immersion washer of claim 14 wherein the rotational blow-off stage rotating mechanism includes a pinion gear connected with said container guide to rotate said guide when the gear is rotated and a rack coupled to said pinion gear and moveable to rotate the pinion gear and container guide during said rotational blow-off drying cycle.

18. The immersion washer of claim 17 wherein the rack is connected to a rod moveable within an actuatable cylinder wherein the cylinder may be actuated during the wash cycle to move the rack against the pinion gear and rotate the container guide.

19. An improved immersion washer with successive stations for washing and drying dirty parts comprising:

a wash station for washing a porous container of dirty parts including a wash tank to hold a cleaning solution and dipping mechanism to receive said container and dip it into said tank to wash the parts in the solution, the dipping mechanism operable to move the container generally up and down in said tank to agitate the container of parts in the solution during a wash cycle;

a rotating mechanism to rotate said container on the dipping mechanism while it is being agitated during the wash cycle;

a pump system to turbulate the cleaning system in said tank around the agitating and rotating container of parts;

a rinsing station spaced to one side of said wash station to receive said container after the wash cycle to rinse any residual cleaning solution from the parts, the rinsing station comprising a rinse tank to hold a rinsing solution and a rinse dipping mechanism to receive said container and dip it into said rinse tank to rinse the parts in the rinsing solution, the rinse dipping solution mechanism operable to move the container generally up and down in said tank to agitate the container of parts in the rinsing solution during a rinse cycle;

a container rotating mechanism to rotate said container while it is being agitated during the rinse cycle;

a rinsing pump system to turbulate the rinsing solution in said rinse tank around the agitating and rotating container of parts;

a drying station spaced to one side of said rinsing station to dry the washed and rinsed parts including a rotational blow-off stage with a rotating mechanism to rotate the container of parts and shake excess rinsing fluid from the parts to facilitate drying of the parts and a stationary blow-off stage to receive said container to further dry the parts after the rotational blow-off stage; and a container transport disposed between said wash station and drying station, said transport drivingly engaging said container to facilitate movement of said container along a path from said wash station to said drying station.

20. The immersion washer of claim 19, further comprising an air circulation system coupled to the blow-off drying stages to circulate air around and through the drying stages to dry the parts.

21. The immersion washer of claim 19 wherein the wash station dipping mechanism and rinsing station dipping mechanism each comprise a vertically moveable dipping frame and a container guide rotatably mounted to each said frame, the container guide supporting and rotating a container of parts on said frame during respective wash and rinsing cycles as the dipping frame is moved vertically up and down.

22. The immersion washer of claim 21 wherein the rotating mechanisms of the wash station and rinsing station each include a pinion gear connected with the respective container guide to rotate said guide when the gear is rotated and a rack coupled to said pinion gear and moveable to rotate the pinion gear and container guide during the wash and rinse cycles.

23. The immersion washer of claim 19 wherein said container transport comprises an indexing system to move the container full of parts along a path through the successive stations, the indexing system including a generally horizontal beam spaced above the successive stations and moveable thereat and a plurality of indexing arms extending downwardly from said beam to engage the containers of parts for movement through the successive stations of the immersion washer, each arm operable to engage a first container and move the container along the path through one station and onto the next successive station when the beam is moved in one direction and to disengage from said first container and move to engage a second container positioned behind the first container in the path when the beam is moved in the opposite direction;

whereby a forward and backward motion of the beam moves the containers through the successive stations.

24. The immersion washer of claim 1 wherein the rinse dipping mechanism comprises a vertically movable dipping frame and a container guide rotatably mounted to said dipping frame, the container guide supporting and rotating a container of parts on said frame during the rinse cycle as the dipping frame is moved vertically up and down.

25. The immersion washer of claim 24 wherein the rinse rotating mechanism includes a pinion gear connected with said container guide to rotate said guide when the gear is rotated and a rack coupled to said pinion gear and moveable to rotate the pinion gear and container guide during the rinse cycle.

* * * * *